United States Patent [19]

Scherrer et al.

[11] 3,931,703

[45] Jan. 13, 1976

[54] CORRECTING DEVICE FOR AN ELECTRONIC WATCH

[75] Inventors: Igor Scherrer, Colombier; Fernand Chetelat, Cortaillot; Pierre Hersberger, Neuchatel, all of Switzerland

[73] Assignee: Ebauches S.A., Switzerland

[22] Filed: Jan. 18, 1974

[21] Appl. No.: 434,666

[30] Foreign Application Priority Data

Feb. 27, 1973 Switzerland ..... 2800/73

[52] U.S. Cl. ..... 58/23 R; 58/85.5

[51] Int. Cl.[2] ..... G04C 3/00; G04B 27/08

[58] Field of Search ..... 58/23 R, 50 R, 34, 85.5

[56] References Cited

UNITED STATES PATENTS

| | | | |
|---|---|---|---|
| 3,668,859 | 6/1972 | Polin et al. | 58/85.5 |
| 3,733,803 | 5/1973 | Hiraga et al. | 58/85.5 |
| 3,777,471 | 12/1973 | Koehler et al. | 58/85.5 X |
| 3,786,625 | 1/1974 | Sauthier | 58/85.5 |
| 3,812,669 | 5/1974 | Wiget | 58/23 R |

OTHER PUBLICATIONS

H. J. Benscher et al. "Electronic Switching Theory and Circuits," Van Nostrand Reinhold Co., New York, N.Y., 1971, pp. 63, 64.

*Primary Examiner*—L. T. Hix
*Assistant Examiner*—U. Weldon
*Attorney, Agent, or Firm*—Robert E. Burns; Emmanuel J. Lobato; Bruce L. Adams

[57] ABSTRACT

A device for correcting running of an electronic watch comprises two contactors acting on respective bistable circuits in turn acting on a combinatory circuit controlling a counter which provides binary correction information to an inhibitor circuit. The latter is arranged to inhibit a number of pulses of a pulse generator having a predetermined nominal frequency above a given value, to set the frequency at said given value prior to division to provide accurate clock pulses fed to a device for indicating the time. Successive actuation of respective contactors corresponds to increasing or decreasing the number of inhibited pulses from an approximate number stored in a programmable memory.

4 Claims, 3 Drawing Figures

CORRECTING DEVICE FOR AN ELECTRONIC WATCH

The present invention relates to a device for correcting the running of an electronic watch comprising at least one source of electrical energy, a pulse generator whose output frequency in Hertz has a predetermined nominal value with an approximate positive tolerance of one per ten thousand, a divider circuit adapted to act on the pulse generator output so as to emit an accurate predetermined frequency signal, and a device for indicating the time controlled by this signal.

There are two known types of correcting device.

The first type corrects the frequency of the oscillations of the actual oscillator by means of a trimmer connected in the case of a quartz oscillator in series with the quartz. These devices are not satisfactory as the trimmers cannot have large dimensions, their capacity is limited and consequently the range of regulation is in turn limited. The capacity variation characteristic of the trimmers is generally logarithmic, which makes correction difficult. Several successive measurements and corrections are generally necessary for an acceptable regulation of the frequency to be obtained. Very accurate apparatus and considerable regulating time are required for obtaining accurate running.

The second known type of correcting device uses a digital correction which is carried out by suppressing, at the input of the frequency divider and at a predetermined rate, a certain number of pulses provided by an oscillator whose frequency is higher than a nominal value.

A device according to the invention is of the second type.

In known devices of the second type, the number of pulses suppressed is determined either by the adjustable period of an astable oscillator, or by a series of interrupters whose positions indicate the number of pulses to be suppressed in binary arithmetic.

For the period of an astable circuit device to be adjustable a capacitance is required, but capacitances may only be integrated in circuits with very large tolerances and severe limitations.

Correcting devices comprising interrupters are complicated. The number of pulses to be suppressed is given in binary form. For example, to provide for a correction of up to 12 seconds per day in jumps of one tenth of a second, or 120 possibilities, it is necessary to use 7 bits, i.e. seven interrupters which together will give $2^7$, or 128 combinations. The watchmaker who has to regulate a watch of this type will have to open all the interrupters, measure the advance of the oscillator of the watch with a very accurate apparatus and then determine from this measured advance which interrupters have to be closed. To carry out this last operation, it is necessary to consult a table comprising the 127 regulating combinations of 1 to 126 tenths of a second per day. In view of its dimensions, this table cannot be integrated in the watch. This is a disadvantage since each make may have its own code so that the watch-maker must have the tables of all makes of watch which he may desire to regulate. After consulting the relevant table the watch-maker will then have to close the interrupters indicated by the table for the desired correction. Another disadvantage of this device is the considerable space which the 7 interrupters, which each must be directly accessible, occupy in the watch.

It is an object of the present invention to provide a watch of the second type which obviates or mitigates the above mentioned disadvantages by eliminating the requirement for tables and the operation of numerous interrupters.

According to the present invention, there is provided a device for correcting the running of an electronic watch having at least one source of electrical energy, a pulse generator whose output frequency in Hertz has a predetermined nominal value, a divider circuit adapted to act on the pulse generator output so as to emit a predetermined accurate frequency signal and a device for indicating the time controlled by this signal, the device comprising two contactors each connected to act on a respective bistable circuit, two bistable circuits being connected to act on a combinatorial circuit at the input of a counter arranged to provide binary correction information to an inhibitor circuit, the inhibitor circuit being arranged to send at a predetermined rate, a number of pulses for inhibiting a corresponding number of pulses of the oscillator, one of the contactors by its operation being arranged to increase the number of inhibiting pulses, the other being arranged to decrease the number of inhibiting pulses.

The accompanying drawings illustrate, by way of example, one embodiment of a correcting device according to the invention.

Figure 1A:
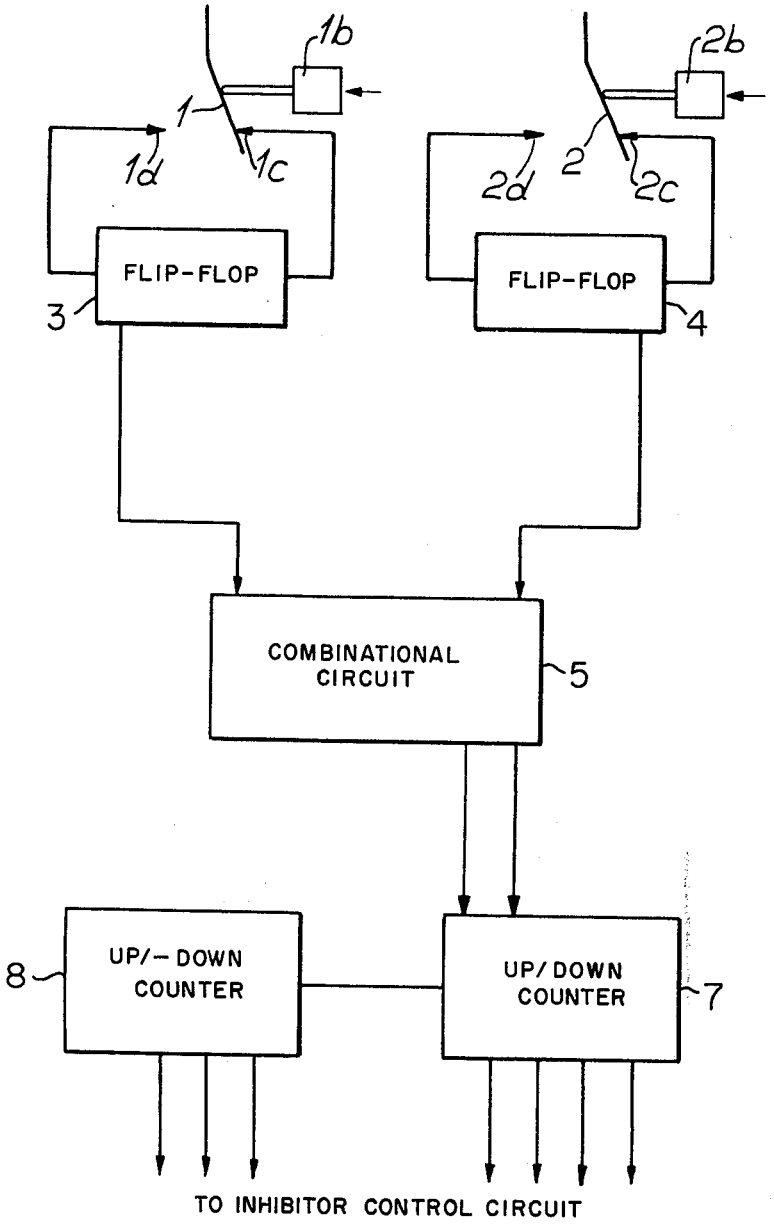
FIGS. 1a and 1b are a circuit diagram of the device.
Figure 1B:
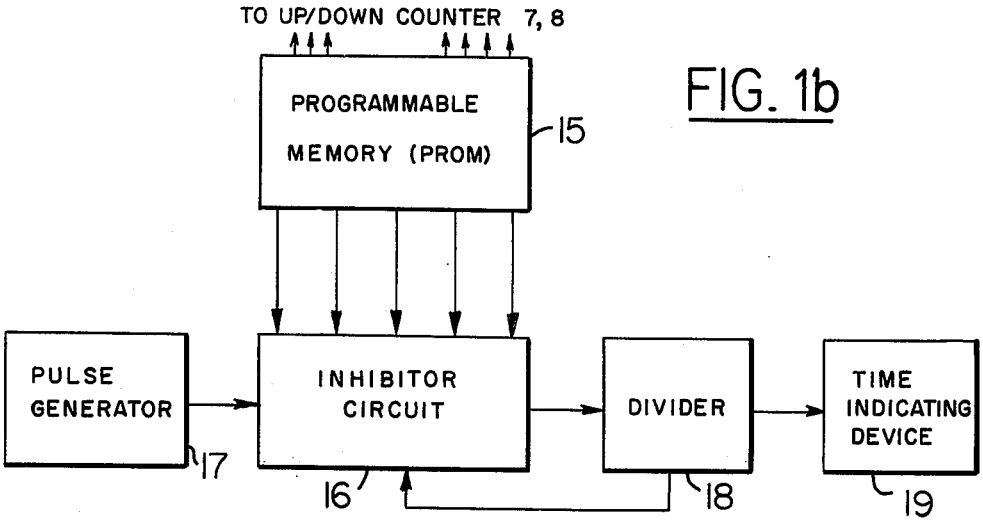
Figure 2:
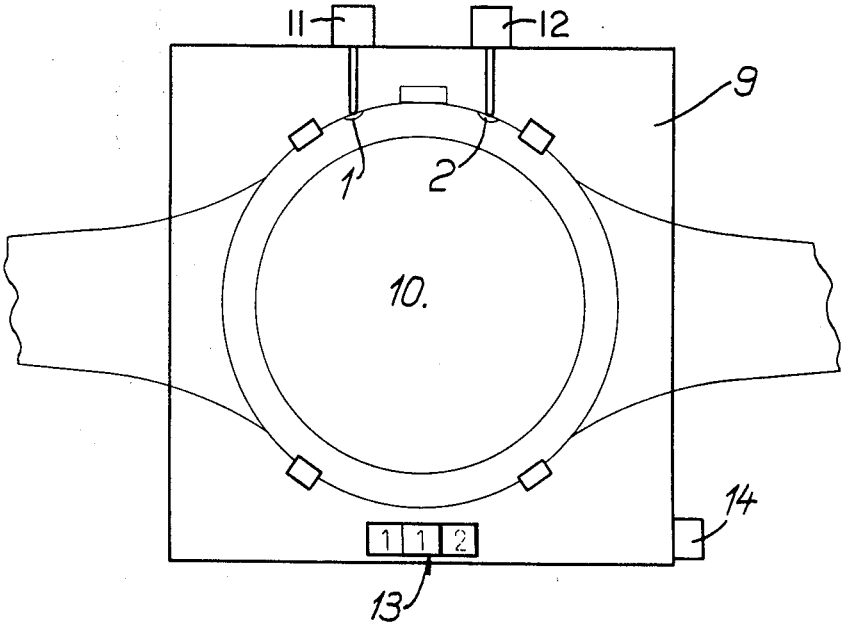
FIG. 2 is a diagrammatic view of an apparatus for actuating the device.

The device illustrated in the circuit diagram of FIG. 1 is intended to correct the running of a standard electronic watch comprising a pulse generator, preferably a quartz pulse generator, whose frequency is for example $2^{15}$ Hertz with an approximate positive tolerance of one per ten thousand. There is no need for this frequency to be accurately selected provided that it is greater than $2^{15}$. As known, the pulse generator acts on a divider circuit whose output pulses are sent to a device for indicating the time, which device may be either digital or provided with hands. These components of watches are known and will not be further described.

A programmable memory which is programmed at the factory determines the approximate state of running of the watch by providing a signal in binary form to an inhibitor circuit. This memory will be of the RAM, ROM or PROM type, preferably of the latter type, which is able to store the information received. The memory is receptive of and stores time correction signals stored in a counter, described herein below, and converts the counter contents to a binary format for controlling the inhibitor circuit.

The device comprises two contactors or switches 1 and 2 which may each be actuated by respective push-buttons 1*b* and 2*b*. These contactors are formed by a strip which is normally in stationary contact with respective contact-studs 1*c* and 2*c*. When a push-button is actuated, the respective strip comes into contact with the respective contact-stud 1*d* or 2*d*. The contact-studs 1c and 1d of the first contactor 1 are connected to the two set and re-set inputs of a flip-flop circuit 3. The contact-studs 2*c* and 2*d* of the second contactor 2 are connected to the two set and re-set inputs of a flip-flop circuit 4.

The outputs of the flip-flops 3 and 4 are connected to a combinatorial logic circuit 5. This circuit is commercially available. One example is the RCA CD 4011A, described in the RCA Solid State Databook SSD-203A (1973).

It should be noted that since the triggering of the flip-flop takes place at the time of pressure on the contactor, the possible return movement at the time of release has no effect on the operation of the device.

When it is triggered, the flip-flop 3 provides the logic circuit 5 with an addition pulse. When it is triggered, the flip-flop 4 provides the logic circuit 5 with a subtraction pulse.

For the final correction, these pulses are sent to an up/down counter 7, 8 which counts them and transmits the total count in binary form to an inhibitor control circuit 15. By setting the switches 1 and 2, the count stored in the up/down counter can be varied to control the inhibitor 16 to control the number of pulses applied to the divider 18 and thus control the time indicating mechanism 19. Controllable inhibitor circuits of the type described hereinabove are known and the structure of one example is disclosed in Swiss Patent Application Ser. No. 534,913. The count stored in up/down counter 7, 8 is applied to and stored in the programmable memory (PROM) 15. The format of the count is changed to a binary format for controlling the inhibitor circuit 16 to block certain numbers of pulses from the pulse generator 17. The pulses which are passed by the inhibitor 16 are applied to the divider 18 which develops a time signal to drive the time indicating device 19.

The circuits are arranged such that pressure on the push-buttons 1*b* or 2*b* corresponds to a correction of operation on one tenth of a second, actuation of the push-button 1*b* increasing the number of inhibiting pulses to create an advance, actuation of the push-button 2*b* decreasing the number of inhibiting pulses to create a retard.

The counter 7,8 may be reset to zero by simultaneous action of the two push-buttons.

To facilitate the operation of the contactors 1 and 2, a small apparatus 9 has been designed in which the watch 10 is fixed. The two contactors 1 and 2 of the watch are located in front of rods of two push-buttons 11 and 12 supported by the apparatus 9.

By acting on either push-button of the apparatus, one actuates the corresponding push-button of the watch.

The push-buttons of the apparatus are mechanically connected to a small counter 13 which counts the correction carried out in one tenths of a second. This small counter may be reset to zero by a button 14.

To regulate a watch provided with the illustrated device, the correction which is required is measured on a known apparatus, and the correction is made by pressing the advance or retard push-button depending on the direction of correction required as many times as there are tenths of a second to be corrected. This is very simple and may be undertaken by the watchmaker without any dismantling of the watch.

In an alternative arrangement which is not shown, the push-buttons may be located inside the casing of the watch. Corrections will thus be carried out by the watchmaker after opening the casing.

We claim:

1. A time setting circuit for correcting the time setting of an electric timepiece of the type having a pulse generator having an output frequency set to a predetermined nominal value, a divider circuit receptive of the pulse generator output for developing a time signal having a frequency determined by the divider circuit, a controllable inhibitor circuit for blocking selected pulse generator output pulses from the divider circuit, and a time indicating mechanism driven by the time signal, wherein the time setting circuit comprises:

a. two bistable circuits each having an output representative of a conductive state of the respective bistable circuit;

b. two switches each connected to control the conductive state of a respective one of said two bistable circuits;

c. an up/down counter for counting pulses;

d. means for applying the count stored in said up/down counter to the controllable inhibitor circuit to control the number of pulses blocked by said inhibitor circuit and thereby control the time indicating mechanism; and e. a combinatorial circuit receptive of the outputs of said two bistable circuits for applying pulses to said up/down counter for increasing the count stored therein in response to actuation of a first of said two switches and for applying pulses for decreasing the count stored therein in response to actuation of a second of said two switches.

2. A time setting circuit according to claim 1, wherein the two bistable circuits are flip-flop circuits connected to be triggered when said respective switches are closed so that opening of the switches has no effect on the operation of the time setting circuit.

3. A time setting circuit according to claim 1 in, further comprising combination with said switches, bistable circuits, combinational circuit and inhibitor of an electric timepiece, means for supporting said timepiece for the correction of running thereof, said supporting means including two push buttons adapted to act at least indirectly on respective ones of said two switches of said timepiece, and counter means for providing a visual digital indication of the number of successive actuations of either of said push buttons.

4. A device according to claim 1, where said means for applying the count stored in said up/down counter comprises programmable memory means for providing to the inhibitor circuit binary information about the running of the timepiece, said memory means being able to store information received from said counter.

* * * * *